United States Patent [19]

Namikawa et al.

[11] Patent Number: 4,910,555

[45] Date of Patent: Mar. 20, 1990

[54] ELECTROPHOTOGRAPHIC DEVICE WITH CONTROLLED EXPOSED POTENTIAL

[75] Inventors: Osamu Namikawa; Yasuo Kikuchi; Minoru Seino; Hiroshi Ueno; Koji Doi; Tsukasa Onose; Shigenobu Katagiri; Toshitaka Ogawa, all of Ibaraki, Japan

[73] Assignee: Hitachi Koki Co., Ltd., Tokyo, Japan

[21] Appl. No.: 267,843

[22] Filed: Nov. 7, 1988

[30] Foreign Application Priority Data

Nov. 6, 1987 [JP] Japan ..... 62-281493

[51] Int. Cl.[4] ..... G03G 15/02

[52] U.S. Cl. ..... 355/214; 355/219; 355/225; 346/160.1

[58] Field of Search ..... 355/208, 214, 216, 219, 355/225, 268, 210; 430/902; 346/160, 160.1

[56] References Cited

U.S. PATENT DOCUMENTS 3,997,259 12/1976 Bhaget ..... 355/214
4,408,871 10/1983 Kojima ..... 355/219 X

FOREIGN PATENT DOCUMENTS 61-88283 5/1986 Japan ..... 355/225

*Primary Examiner*—Joan H. Pendegrass
*Attorney, Agent, or Firm*—Cushman, Darby & Cushman

[57] ABSTRACT

An electrophotographic device has a photosensitive element, an electrifier that forms a uniform electrostatic potential on the photosensitive element, and a light source for irradiating the photosensitive element to obtain an electrostatic latent image that has a reduced potential. A bias potential is applied to the photosensitive element after the latent image is formed, but before it is developed, so that the reduced potential of the latent image can be maintained at a constant level. With constant potentials existing on the photosensitive element, a printed image of high quality is obtained.

14 Claims, 3 Drawing Sheets

ELECTROPHOTOGRAPHIC DEVICE WITH CONTROLLED EXPOSED POTENTIAL

BACKGROUND OF THE INVENTION

1. Field of the Art:

The present invention relates to an electrophotographic device such as laser printer.

2. Background of the Prior Art:

A known electrophotographic device is shown in FIG. 2 and includes a photosensitive element 12 having a photosensitive film 14, such as amorphous selenium, placed over an electrically conductive member 16, such as aluminum. The photosensitive element 12 is charged by an electrifier 18 to an electrostatic potential Vo and then selectively exposed to laser beams 26.

Photosensitive film 14 is a dielectric in its unexposed state, but loses much of its dielectric qualities after exposure to laser beam 26, thus exhibiting properties of a conductor and the accumulated charge on the exposed areas flow to ground via conductive member 16. This results in exposed areas having a reduced potential Vr that is lower than the electrostatic potential Vo. The whole unexposed area is typically referred to as the electrostatic latent image.

The electrostatic latent image is then developed into a printed visible image using a developing machine, not shown in FIG. 2.

The values of Vo, Vr, and, Vo−Vr are extremely important in determining the quality of the print, and must be kept at constant values. However, these values have, in the past, been very dependent on the physical properties of photosensitive element 12. Also, temperature variations have caused deviations from constant values as shown in FIG. 3. The result of this is that lower quality printed images are obtained.

One known manner to keep these potentials constant measures the electrostatic potential Vo and uses this measured potential to vary the voltage applied by electrifier 18 shown in FIG. 2. This results in a constant electrostatic potential Vo, but the reduced potential Vr can still vary a great deal. For, example, as shown in FIG. 4, for varying temperatures, the electrostatic potential Vo is constant, but reduced potential Vr changes considerably.

Attempts have also been made to use materials that will cause these potential maintain a more constant value. However, the result of these attempts has been very expensive machinery that still does not adequately keep these potentials at a constant value.

Thus, an electrophotographic device that can maintain both a constant electrostatic potential Vo and a constant reduced potential Vr is needed.

SUMMARY OF THE INVENTION

It is, therefore, the object of the present invention to provide an electrophotographic device capable of maintaining the electrostatic potential Vo and reduced potential Vr at constant levels, regardless of the physical properties of the photosensitive element.

It is another object of the present invention to provide an electrophotographic device capable of maintaining the electrostatic potential Vo and reduced potential Vr at constant levels for a wide range of temperatures.

To attain these objects, and others, the present invention measures the applied electrostatic potential Vo and uses this measured value to control the bias voltage of the electrifier that charges the photosensitive element to the electrostatic potential Vo. This maintains the electrostatic potential at a constant value. The reduced potential Vr is maintained at a constant level by applying a bias voltage Vb to portions of the photosensitive element where the latent image exists with another electrifier. By varying the bias voltage Vb, a constant reduced potential results.

In a preferred embodiment, the electrostatic potential Vo and the reduced potential Vr are sensed using separate potential measurement instruments.

In a modification of the preferred embodiment, the electrostatic potential Vo and the reduced potential Vr are sensed using the same measurement instruments.

These embodiments provide an electrophotographic device that produces high quality printed images due to the constant potentials that exist before development of the image.

BRIEF DESCRIPTION OF THE DRAWINGS

These and other advantages of the present invention may be appreciated from studying the following detailed description of the preferred embodiment with reference to the drawings in which.

DETAILED DESCRIPTION OF THE PREFERRED EMBODIMENT

Figure 1:
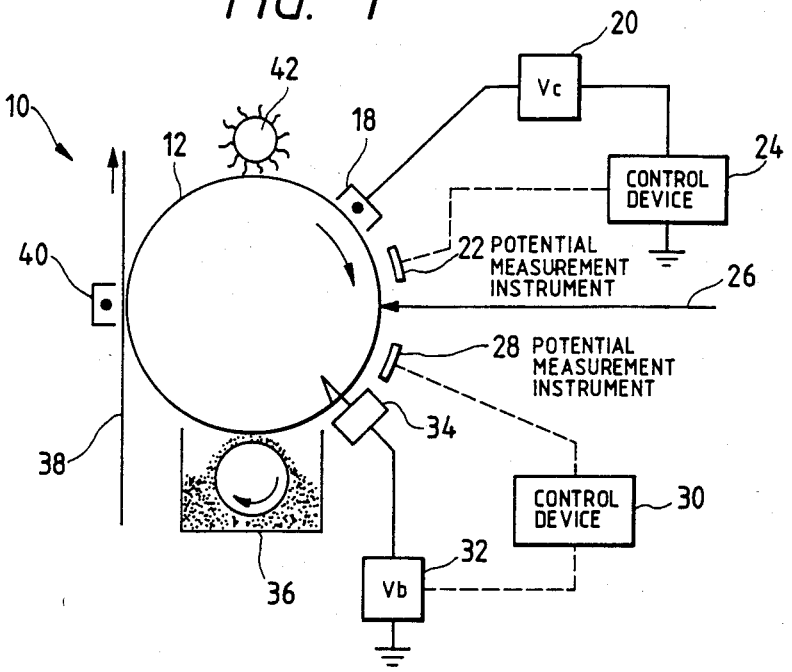
FIG. 1 is a diagram showing an embodiment of the present invention.
Figure 2:
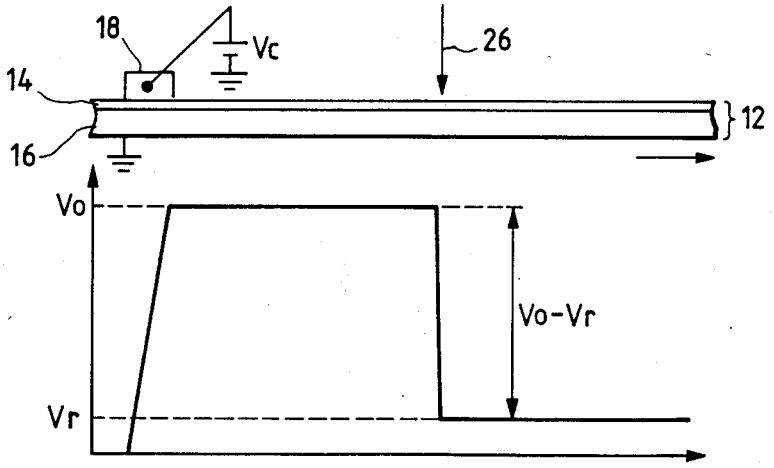
FIG. 2 PRIOR ART
FIG. 2 is a schematic diagram showing a prior art electrophotographic device.
Figure 3:
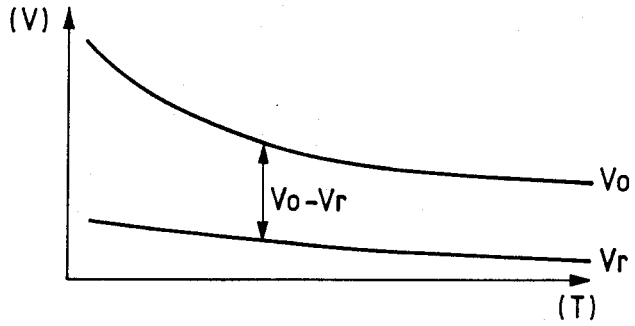
FIG. 3 PRIOR ART
FIG. 3 is a graph showing the range of values for the difference Vo−Vr as a function of temperature in accordance with the prior art.
Figure 4:
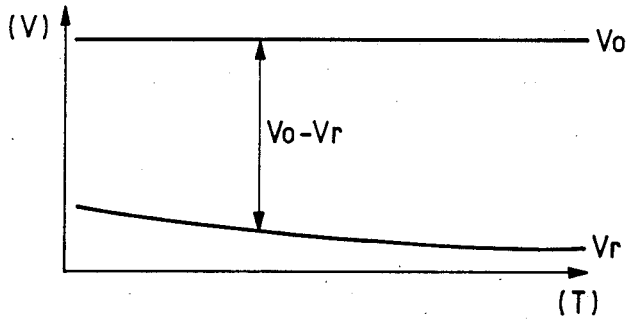
FIG. 4 PRIOR ART
FIG. 4 is a graph showing the range of values for the difference Vo −Vr as a function of temperature using a prior art arrangement that attempts to keep this difference a constant value.

FIG. 1 shows the preferred embodiment of an electrophotographic device 10. A photosensitive element 12, which is cylindrically shaped, is charged to an electrostatic potential Vo as each point of photosensitive element 12 rotates past electrifier 18.

As each point of photosensitive element 12 rotates further, its electrostatic potential Vo is measured by potential measuring instrument 22. The output of potential measuring instrument 22 is input to a control device 24 and used to adjust the voltage Vc of power supply 20. Specifically, control device 20 compares the output of potential measuring instrument 22 to a reference signal $Vo_{ref}$. Control device 20 outputs a signal that causes power supply voltage Vc to equal $Vo_{ref}$, thus causing the electrostatic potential Vo that is charged on photosensitive element 12 to have a constant value equal to $Vo_{ref}$.

An electrostatic latent image is then formed at various portions of photosensitive element 12 as each point of photosensitive element 12 rotates past laser beams 26.

This electrostatic latent image has a reduced potential Vr.

After the electrostatic latent image is formed, the reduced potential Vr of the various points that make up the latent image is measured by potential measurement instrument 28. The output of potential measurement instrument 28 is input to control device 30. Control device 30 compares this output with a reference signal $Vr_{ref}$. The difference between these values is used to control the output voltage Vb of power supply 32. Output voltage Vb is then applied to the latent image so that the reduced potential Vr maintains a constant value $Vr_{ref}$. The output voltage Vb can provide an applied voltage of positive or negative polarity to the photosensitive element 12 so that the constant value of reduced potential Vr can be maintained.

The latent image thus formed is developed into a visible image by a developing machine 36, and the visible image is transferred to printing paper 38 using a transfer unit 40. Cleaner 42 then removes the residual image from photosensitive element 12.

Figure 5:
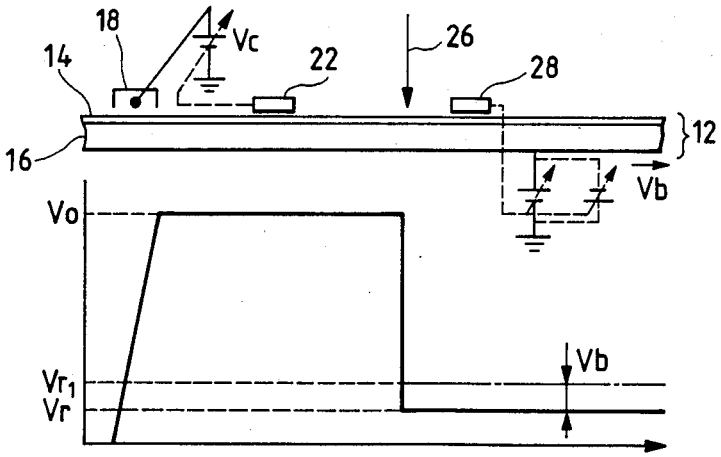
FIG. 5 is a schematic diagram illustrating the device according to the present invention and a graph showing the influence of a temperature change on the potential of the photosensitive element.

FIG. 5 also schematically shows the change of the surface potential of photosensitive element 12 as a function of temperature with the system, as mentioned previously. With this change in temperature, the reduced potential Vr also changes, for example, to a value Vn as shown. Prior art systems could not compensate for this change in potential. However, the device described above can compensate for this change in temperature. As shown in FIG. 5, although the temperature will cause a change in the reduced potential Vr, the difference between this value Vn and $Vr_{ref}$ will be detected and voltage Vb applied so that reduced potential Vr maintains a constant value at $Vr_{ref}$.

An alternative embodiment will now be described with reference to FIGS. 6 and 7. In the FIG. 1 embodiment, the potentials Vo and Vr were measured using both electrometer 22 and the electrometer 28. In the FIGS. 6 and 7 embodiment only a single electrometer 42 is required. Electrometer 42 is positioned to measures the potential of photosensitive element 12 after it has been charged by electrifier 18 and illuminated by laser beam 26.

Figure 6:
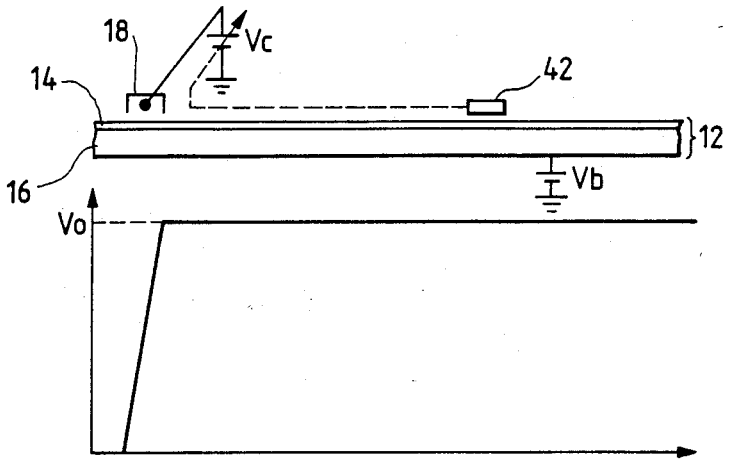
FIG. 6 illustrates a modification of the preferred embodiment.
Figure 7:
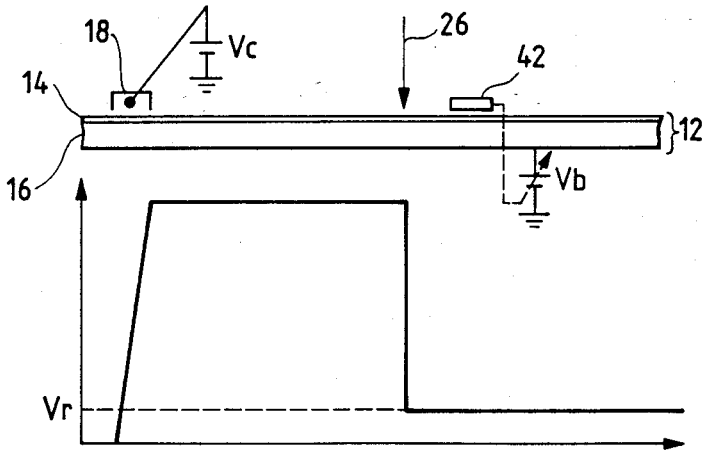
FIG. 7 further illustrates the modification of the preferred embodiment shown in FIG. 6.

The electrostatic potential Vo on photosensitive element 12 is first measured by potential measuring instrument 42 as shown in FIG. 6, and the output voltage of the power supply 20 is varied by control device 24 so that as this measurement is repeated, the electrostatic potential Vo is brought to and then remains at a constant value $Vo_{ref}$. Until electrostatic potential Vo is brought within a predetermined range of $Vo_{ref}$, bias voltage Vb is kept fixed at a certain initial value. This typically takes place before attempting to make a printed image, and, therefore, before exposing photosensitive element 12 to laser beam 26.

However, once electrostatic potential Vo is within this predetermined range, potential measuring instrument 42 is also used to measure the value of reduced potential Vr. The measured reduced potential Vr can then be input into control device 30 to control the bias voltage Vb applied to the latent image of photosensitive element 12 with electrifier 34. Thus, reduced potential Vr is maintained at a constant value $Vr_{ref}$.

By repeatedly measuring the applied electrostatic potential Vo and reduced potential Vr can be maintained, thereby resulting in a printed image of much better quality.

While the invention has been described in connection with what is the presently preferred embodiment, it is to be understood that the invention is not limited to the disclosed embodiment, but, on the contrary, is intended to cover various modifications and equivalent arrangements included within the spirit and scope of the appended claims.

What is claimed is:

1. An electrophotographic device for obtaining a printed image comprising:

a photosensitive element;

first means for charging said photosensitive element with a first bias voltage to a electrostatic potential;

means for irradiating said photosensitive element with light to obtain a latent image having a reduced potential over a portion of said photosensitive element;

means for detecting said reduced potential;

second means for charging said reduced potential with a second bias voltage so that said reduced potential is uniform over said portion of said photosensitive element;

means for controlling said second bias voltage using said detected reduced potential; and means for developing said latent image to obtain said printed image.

2. A device according to claim 1 wherein said illuminating means is a laser.

3. A device according to claim 1 wherein said first charging means includes a first electrifier and a first power supply and said second charging means includes a second electrifier and a second charging means.

4. A device according to claim 1 further including means for cleaning said photosensitive element.

5. A device according to claim 1 wherein said photosensitive element has a cylindrical shape.

6. A device according to claim 1 wherein said photosensitive element includes a photosensitive film disposed over a conductive layer.

7. A device according to claim 6 wherein said photosensitive element is amorphous selenium and said conductive layer is aluminum.

8. An electrophotographic device for obtaining a printed image comprising:

a photosensitive element;

first means for charging said photosensitive element with a first bias voltage to a electrostatic potential;

means for irradiating said photosensitive element with light to obtain a latent image having a reduced potential over a portion of said photosensitive element;

means for detecting said potentials on said photosensitive element;

first means for controlling said first bias voltage using said detected potential so that said electrostatic potential is uniform over the surface of said photosensitive element;

second means for charging said reduced potential with a second bias voltage so that said reduced potential is uniform over said portion of said photosensitive element;

second means for controlling said second bias voltage using said detected potential; and means for developing said latent image to obtain said printed image.

9. A device according to claim 8 wherein said irradiating means is a laser.

10. A device according to claim 8 wherein said first charging means includes a first electrifier and a first power supply and said second charging means includes a second electrifier and a second charging means.

11. A device according to claim 8 further including means for cleaning said photosensitive element.

12. A device according to claim 8 wherein said photosensitive element has a cylindrical shape.

13. A device according to claim 8 wherein said photosensitive element includes a photosensitive film disposed over a conductive layer.

14. A device according to claim 13 wherein said photosensitive element is amorphous selenium and said conductive layer is aluminum.

* * * * *